US007147341B2

(12) United States Patent
Nowak et al.

(10) Patent No.: US 7,147,341 B2
(45) Date of Patent: Dec. 12, 2006

(54) LIGHT ASSEMBLY

(75) Inventors: David R. Nowak, Chicago, IL (US); Richard R. Herzog, Arlington Heights, IL (US)

(73) Assignee: Illinois Tool Works Inc, Glenview, IL (US)

( * ) Notice: Subject to any disclaimer, the term of this patent is extended or adjusted under 35 U.S.C. 154(b) by 15 days.

(21) Appl. No.: 11/197,031

(22) Filed: Aug. 4, 2005

(65) Prior Publication Data

US 2006/0077653 A1 Apr. 13, 2006

Related U.S. Application Data

(60) Provisional application No. 60/617,715, filed on Oct. 12, 2004.

(51) Int. Cl.
*F21V 33/00* (2006.01)
*F21V 21/00* (2006.01)

(52) U.S. Cl. ..... 362/133; 362/374; 362/375; 362/455

(58) Field of Classification Search ..... 362/133, 362/374, 375, 455; 63/441; 312/404
See application file for complete search history.

(56) References Cited

U.S. PATENT DOCUMENTS 6,979,107 B1 * 12/2005 Benensohn ..... 362/374
2003/0151925 A1 * 8/2003 Crunk ..... 362/545
2005/0236947 A1 * 10/2005 LeClear et al. ..... 312/404

* cited by examiner

*Primary Examiner*—Sandra O'Shea
*Assistant Examiner*—James W Cranson, Jr.
(74) *Attorney, Agent, or Firm*—Mark W. Croll; Paul F. Donovan

(57) ABSTRACT

A light assembly for a refrigerator drawer includes a light source assembly, a reflector and a lens assembly keyed one to another for positioning, and secured to each other as a preassembled unit. The preassembled light assembly is snap fit into an opening in a panel of the drawer.

20 Claims, 3 Drawing Sheets

LIGHT ASSEMBLY

CROSS-REFERENCE TO RELATED APPLICATIONS

The present regular U.S. Patent Application claims the benefits of U.S. Provisional Application Ser. No. 60/617,715 filed on Oct. 12, 2004.

FIELD OF THE INVENTION

The present invention pertains generally to appliance lighting systems, and, more particularly, the invention pertains to light assemblies suitable for use in a refrigerator drawer.

BACKGROUND OF THE INVENTION

Refrigerators and other appliances have evolved from simple devices that perform the basic functions intended to sophisticated appliances having features and functions for convenience as well as utility. Lighted interiors are commonly provided for user convenience. For example, both freezer and refrigerator compartments of refrigerator appliances have been known to include lights that are actuated upon opening of the door to the compartment.

Refrigerators are known to include one or more sliding drawers for separately holding meat, produce or other items. It is known to provide controls for the temperature and/or humidity of a drawer interior separately from the control of the refrigerator compartment itself. The controls can be made readily accessible in the drawer front between inner and outer panels of the drawer front. The drawers are deep and, if full, the interior of the drawer can appear quite dark, even when the drawer is opened in a lighted refrigerator interior. The light for the main area of the refrigerator compartment may not cast light into the drawer when the drawer is pulled open. Reading package labels and identifying small items in the drawer can be difficult. Accordingly, there are advantages in providing lights directly within the interior space of a refrigerator drawer.

It also is desirable to maximize the useable space for food storage within a refrigerator. Preferably, the amount of useful food-storage space is maximized within the overall volume of the refrigerator. Drawers alone reduce the storage space available within a refrigerator since space is required for suspending structures, slide systems and the like necessary for operating the drawer. To maximize the food storage space within the drawer, it is known to provide the drawer made of single panels on the front, back, sides and bottom. The drawer front also is known to be provided as a two panel structure, with a small space between inner and outer panels sufficient for holding a louver and controls for adjusting circulation through the drawer.

It is desirable to provide a light for the interior of refrigerator drawers to light the drawer interior directly, rather than indirectly as from a more generally located light in the refrigerator compartment. However, since drawer space is often small, it is undesirable to have a light structure that extends only minimally into the drawer.

What is needed is a light provided within a refrigerator drawer, which extends only minimally into the drawer interior, thereby not reducing the storage space significantly.

SUMMARY OF THE INVENTION

The present invention provides a light assembly suitable for use in refrigerator drawers which can be preassembled, has a thin profile and can be fitted between inner and outer panels of a refrigerator drawer front or within a small housing on the drawer.

In one aspect thereof, the present invention provides a light assembly with a light emitting source, a reflector and a lens assembly. A first keying means has a first keying means first component associated with the light source assembly and a first keying means second component associated with the reflector cooperating for assembling the light source assembly and the reflector in a selected orientation with respect to each other. A second keying means has a second keying means first component associated with the reflector and a second keying means second component associated with the lens assembly cooperating for assembling the reflector and the lens assembly in a selected orientation with respect to each other. A fastener secures the light source assembly and the lens assembly to each other with the reflector held there between.

In another aspect thereof, the present invention provides an illuminated refrigerator drawer with a panel defining an opening therein and a light assembly secured in the opening. The light assembly includes a light source assembly having a light emitting source, a reflector and a lens assembly. A first keying means has a first keying means first component associated with the light source assembly and a first keying means second component associated with the reflector cooperating for assembling the light source assembly and the reflector in a selected orientation with respect to each other. A second keying means has a second keying means first component associated with the reflector and a second keying means second component associated with the lens assembly cooperating for assembling the reflector and the lens assembly in a selected orientation with respect to each other. A fastener secures the light source assembly and the lens assembly to each other with the reflector held there between. Integral snap assemblies secure the light assembly in the opening.

In a still further aspect thereof, the present invention provides an appliance light assembly with a light source assembly including a substrate and a light emitting diode. The substrate defines first and second holes. A reflector includes a funnel-like body, a skirt and first and second posts. The skirt engages the substrate and the posts are disposed in the holes. A lens assembly includes a lens and legs extending from the lens toward the substrate. The legs have hooked ends engaging the substrate with the lens engaging the reflector.

An advantage of the present invention is providing a light assembly suitable for use in refrigerator drawers to directly illuminate the drawer interior.

Another advantage of the present invention is providing a light assembly that is sufficiently thin for installation in the space between an inner panel and an outer panel of a refrigerator drawer front, or in a thin hosing on a single panel drawer front.

Still another advantage of the present invention is providing a light assembly that can be preassembled as a unit for subsequent installation in a refrigerator drawer.

Yet another advantage of the present invention is providing a light assembly for refrigerator drawers in which components thereof are keyed for proper orientation and assembly.

Other features and advantages of the invention will become apparent to those skilled in the art upon review of the following detailed description, claims and drawings in which like numerals are used to designate like features.

Figure 1:
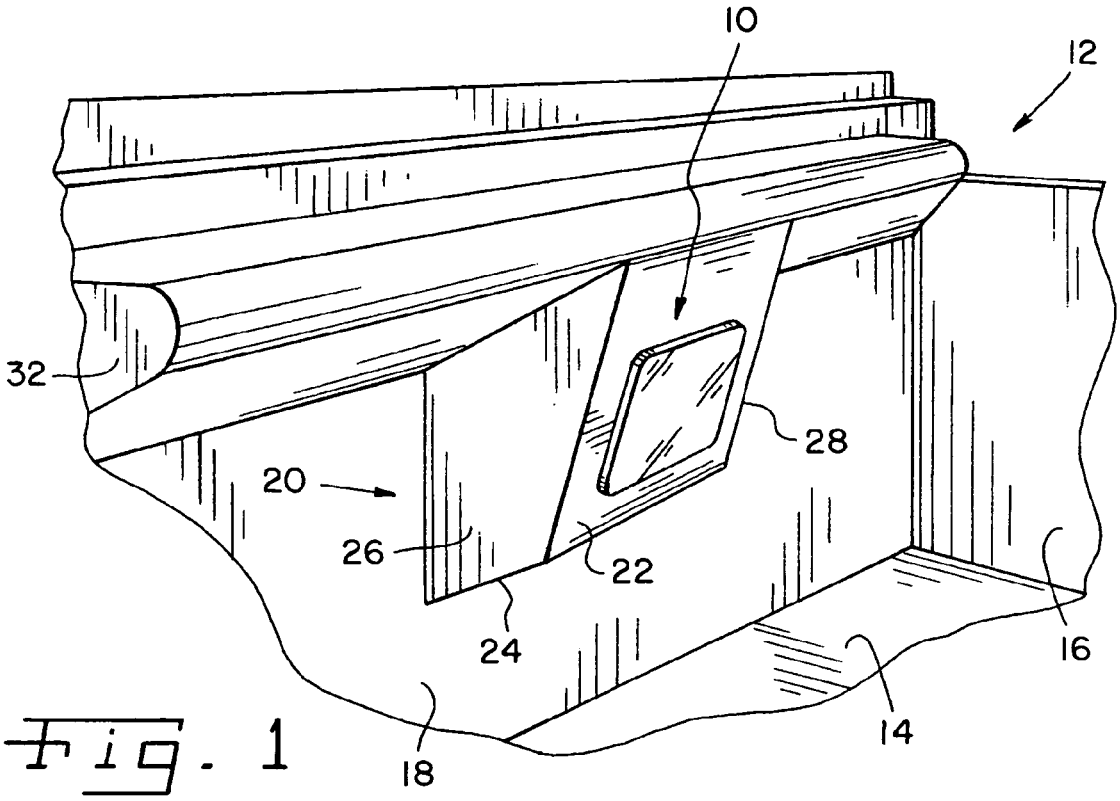
FIG. 1 is a perspective view of a refrigerator drawer with a light assembly in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 10 designates a light assembly in accordance with the present invention which is shown installed in a refrigerator drawer 12. It should be understood that the drawer 12 shown is merely exemplary and drawers of other configurations can use the present invention advantageously as well. Further, while the present invention has a particular suitability for use in refrigerator drawers, a light assembly of the present invention can be used elsewhere in a refrigerator, as well as in other devices. For example, the light assembly can be used in other refrigerator compartments or in other appliances.

Drawer 12 is illustrated only fragmentarily in FIG. 1, and includes a bottom 14, a side 16 and a drawer front 18. Front 18 can be the only front piece in a single wall construction, or can be the inner liner piece of a two wall construction. Drawer 12 further includes a side (not shown) in opposed, spaced relation to side 16 and a drawer back (not shown) in opposed, spaced relation to front 18.

In the exemplary embodiment shown, light assembly 10 is installed in drawer front 12, within a housing 20 projecting only minimally into the interior space of drawer 12. Housing 20 includes a face panel 22, a base 24 and opposed edge panels 26 and 28, and defines a space for receiving light assembly 10 therein exposed through an opening 30 defined in face panel 22. As shown in the exemplary embodiment, housing 20 extends no further into drawer 12 than does a top handle assembly 32 along the top edge of front 18. In other drawer structures, such as when front 18 is the liner of a two wall construction, housing 20 can be eliminated, and light assembly 10 can be installed between an inner panel and an outer panel of the drawer structure.

Light assembly 10 is positioned to cast light into the interior space defined above bottom 14 and between front 18, side 16 and the opposed side and back not shown. In the exemplary embodiment shown in FIG. 1, light assembly 10 is positioned near the upper limit of drawer 12, immediately below handle assembly 32. Light assembly 10 is angularly oriented with respect to front 18, to cast light rearward and downward within drawer 12 from the position of light assembly 10 on front 18. It should be understood that other positions and orientations for light assembly 10 can be used as well. Further, in some uses, such as for larger drawers, it may be desirable to use two or more light assemblies 10 in a single drawer.

Figure 2:
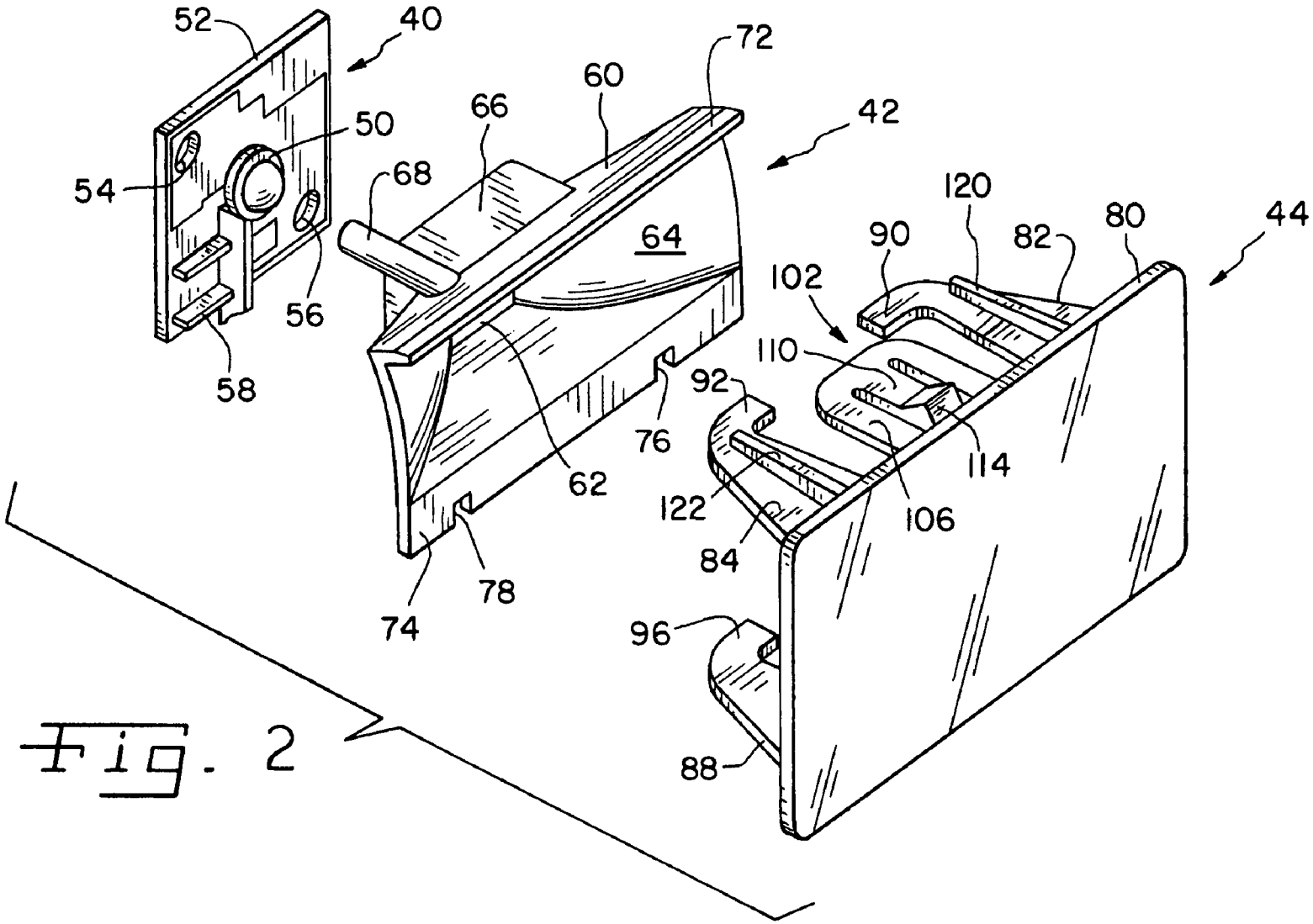
FIG. 2 is an exploded view of the light assembly in accordance with the present invention.

As shown most clearly in FIG. 2, light assembly 10 includes a light source assembly 40, a reflector 42 and a lens assembly 44. As will be described more fully hereinafter, light source assembly 40, reflector 42 and lens assembly 44 are configured for assembly to each other such that each can be positioned with respect to the adjacent component in only one way, and all are secured together in a self-securing manner when positioned properly. Thus, light assembly 10 can be preassembled and thereafter installed in drawer 12. Preassembly can occur at a location different from the final assembly of the refrigerator.

Light source assembly 40 is the principle illumination component for assembly 10. A light emitting diode (LED) can be used advantageously as the source of light in that LED assemblies are compact, have a long useful life, require minimal energy and produce light efficiently without generating significant heat. Basic LED illumination circuit assemblies are available commercially in various configurations. For the present invention, an LED-containing light source assembly 40 should be relatively compact, and should provide sufficient light to illuminate the entire interior of drawer 12 or a selected region of the drawer interior if multiple light assemblies 10 are used. The amount or intensity light required may vary depending on the size and shape of the drawer. For example, a deep drawer may require more light for adequate illumination than a shallow drawer that may receive some ambient light. The location and intensity of other light sources within the refrigerator may also affect the level of additional light desirable within drawer 12 from light assembly 10.

LED light source assembly 40 includes a LED emitter 50 on a substrate 52, which may be the printed circuit board substrate of the LED circuit. It should be understood that an LED array of multiple individual light emitting diodes on a single substrate 52 can be used as the source of light for light assembly 10. Substrate 52 defines first and second holes 54, 56 there through, and other ridges or formations 58 useful in positioning light source 40 relative to reflector 42 and lens assembly 44, as will be described in greater detail hereinafter.

Reflector 42 has a funnel-like body 60 defining an aperture 62 receiving emitter 50 therein in the completed assembly. Body 60 has a light-reflective inner surface 64 for distributing light from light source assembly 40. Polycarbonate is one suitable material for reflector 42, and reflective inner surface 64 can be a coating of aluminum or other reflective material. Body 60 is configured to distribute light in an advantageous pattern to illuminate the interior of drawer 12. A skirt 66 extends from body 60 toward light source 40 to engage substrate 52, stabilize reflector 42 against substrate 52 and maintain the desired positioning between light source 40 and reflector 42. First and second posts 68, 70 extend from body 60 toward light source 40 and are received in holes 54, 56 for aligning light source 40 and reflector 42. Body 60 defines a lip 72 and a tongue 74 along opposite edges that confront lens assembly 44. Lip 72 extends toward lens assembly 44 from body 60, whereas tongue 74 is somewhat parallel to lens assembly 44. Tongue 74 defines notches 76 and 78 therein. Lip 72, tongue 74 and notches 76, 78 orient and locate reflector 42 relative to lens assembly 44, as will be described more fully hereinafter.

Figure 3:
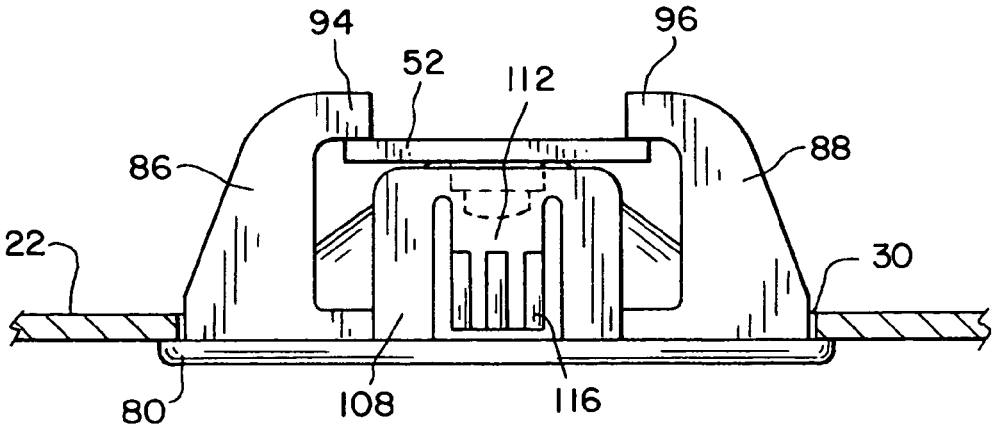
FIG. 3 is a fragmentary cross-sectional view of a refrigerator drawer having a light assembly of the present invention installed therein.
Figure 4:
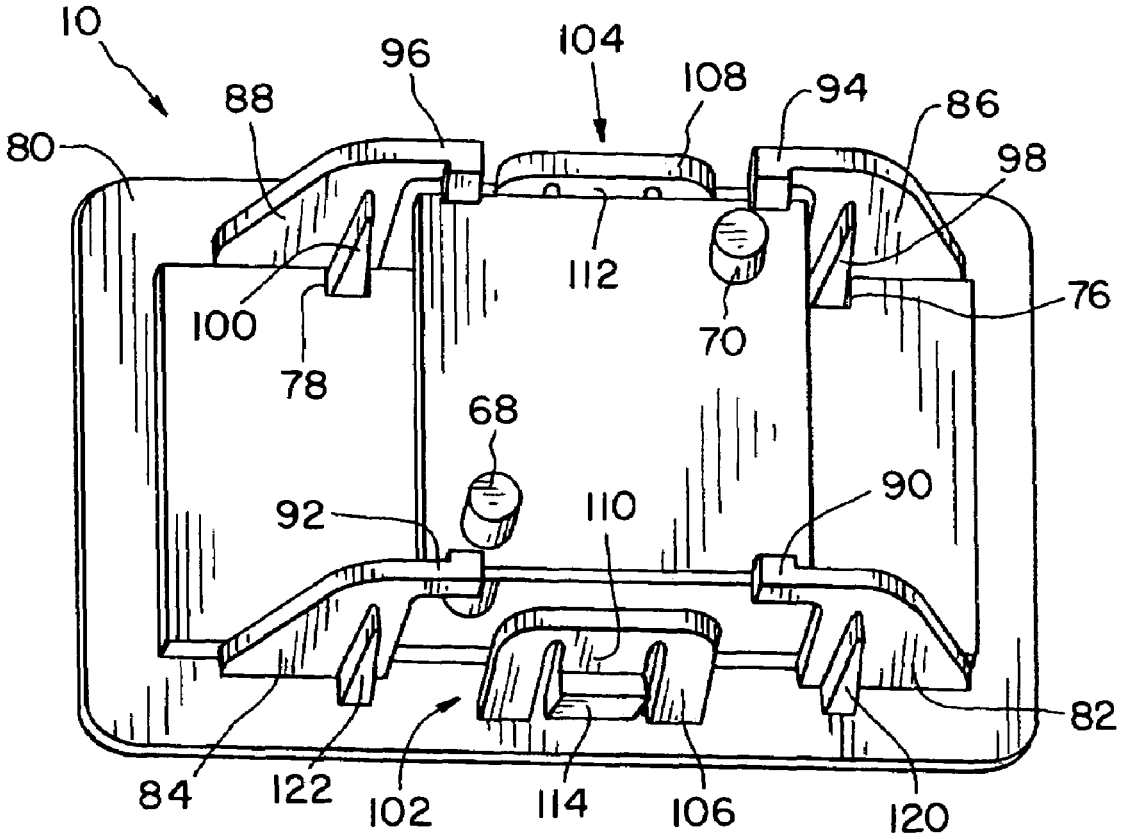
FIG. 4 is a perspective view of the back of the light assembly.

Lens assembly 44 is optically configured to work with reflector 42 to distribute light as desired, and is structurally configured to attach to substrate 52 with reflector 42 sandwiched there between Lens assembly 44 also is configured to secure light assembly 10 in housing 20. Lens assembly 44 also can be made of polycarbonate, and includes an appropriate optical lens 80 and legs 82, 84, 86 and 88 affixed thereto. Legs 82, 84, 86 and 88 are affixed by adhesive, welding or the like to the surface of lens 80 facing toward reflector 42 and light source 40. Alternatively, lens 80 and legs 82, 84, 86 and 88 can be formed as a monolithic body of polycarbonate or other suitable material. Legs 82, 84, 86 and 88 have hook shaped distal ends 90, 92, 94 and 96, respectively. Legs 82, 84, 86 and 88 are of sufficient length to extend past reflector 42, with hooked shaped distal ends 90, 92, 94 and 96 engaging and holding substrate 52 as shown in FIGS. 3 and 4. Ridges 98, 100 on legs 86, 88 are received in notches 76, 78 to properly orient and position lens assembly 44 relative to reflector 42.

Snap assemblies 102 and 104 are provided on opposite sides of lens assembly 44 and are positioned to secure light assembly 10 in opening 30 of housing 20. Snap assemblies 102, 104 include frames 106, 108 and deflectable arms 110, 112, respectively. Arms 110, 112 have outwardly directed tips 114, 116, respectively, to engage edge portions of face panel 22 adjacent opening 30. Snap assemblies 102, 104 can be separately formed and attached to lens 80, or can be formed as part of a monolithic body including lens 80. While the exemplary embodiment shown includes two snap assemblies 102, 104, it should be understood that one or more than two snap assemblies also can be used.

As mentioned previously herein, light assembly 10 can be preassembled and installed in drawer 12 as a single unit. Light source assembly 40, reflector 42 and lens assembly 44 are aligned one with another and secured with hook shaped distal ends 90, 92, 94 and 96 secured beneath the exposed side of substrate 52. First and second keying means are provided between light source 40 and reflector 42, and between reflector 42 and lens assembly 44 to ensure proper alignment of the assembly. When assembling light assembly 10, holes 54, 56 in substrate 52 act as a first keying means first component, and posts 68, 70 extending from body 60 function as a first keying means second component so that light source assembly 40 and reflector 42 are aligned properly one with another, and LED emitter 50 is positioned correctly in aperture 62. The locations of holes 54, 56 with respect to posts 68, 70 and formations 58 can be such as to allow only one orientation of light source assembly 40 relative to reflector 42. Notches 76, 78 function as a second keying means first component, and ridges 98, 100 as a second keying means second component to ensure proper alignment and positioning of reflector 42 relative to lens assembly 44. In the completed assembly, reflector 42 is held securely between light source assembly 40 and lens assembly 44. Skirt 66 is held firmly against substrate 52. Lip 72 and tongue 74 are held firmly against lens 80. In completed light assembly 10, the individual components are restrained against movement with respect to each other by relatively tight fit of posts 68, 70 in holes 54, 56 and ridges 98, 100 in notches 76, 78. Additionally, legs 82, 84, 86 and 88 are provided in pairs on opposite sides of reflector 42 and substrate 52 to further constrain movement.

Completed light assembly 10 is installed in housing 20 by aligning legs 82, 84, 86 and 88 in opening 30 of face panel 22. As light assembly 10 is pushed into opening 30, snap assemblies 102 and 104 engage the edges defining opening 30. Deflectable arms 110 and 112 are deflected inward until tips 114 push completely through opening 30. Arms 110 and 112 rebound outwardly securing edge portions of face panel 22 adjacent opening 30 between tips 114, 116 and lens 80. When installed, light assembly 10 is substantially flush with panel 22, with only lens 80 exposed and extended beyond the outer surface of face panel 22. The remaining structures of light assembly 10 are behind panel 22 and thereby protected from damage. To ensure only one orientation for light assembly 10 in opening 30, orientation ridges 120, 122 are provided to engage notches or grooves (not shown) in an edge defining opening 30

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A light assembly comprising:

a light source assembly including a light emitting source;

a reflector;

a lens assembly;

a first keying means having a first keying means first component associated with said light source assembly and a first keying means second component associated with said reflector, said first keying means first and second components cooperatively associated for assembling said light source assembly and said reflector in a selected orientation with respect to each other;

a second keying means having a second keying means first component associated with said reflector and a second keying means second component associated with said lens assembly, said second keying means first and second components cooperatively associated for assembling said reflector and said lens assembly in a selected orientation with respect to each other; and a connector securing said light source assembly and said lens assembly to each other with said reflector held there between.

2. The light assembly of claim 1, said connector affixed to said lens assembly and connectable to and disconnectable from said light source assembly.

3. The light assembly of claim 1, said connector including a plurality of legs affixed to a lens, each said leg having a foot thereon engaging said light source assembly.

4. The light assembly of claim 1, said light source assembly including a light emitting diode.

5. The light assembly of claim 1, said first keying means including a hole in one of said light source assembly and said reflector, and a post on the other of said light source assembly and said reflector, said post being received in said hole.

6. The light assembly of claim 1, said light source assembly including a substrate defining first and second holes, and said reflector having first and second posts received in said holes.

7. The light assembly of claim 6, one of said reflector and said lens assembly defining a notch, and the other of said reflector and said lens assembly defining a ridge received in said notch.

8. The light assembly of claim 6, said reflector having a tongue defining first and second notches, and said lens assembly having legs defining first and second ridges received in said first and second notches.

9. The light assembly of claim 1, one of said reflector and said lens assembly defining a notch, and the other of said reflector and said lens assembly defining a ridge received in said notch.

10. The light assembly of claim 1, said reflector having a tongue defining first and second notches, and said lens assembly having legs defining first and second ridges received in said first and second notches.

11. The light assembly of claim 1, said reflector having a funnel shaped body defining an aperture, and said light emitting source being disposed in said aperture.

12. The light assembly of claim 11, said reflector including a skirt disposed against said light source assembly and surfaces disposed against said lens assembly.

13. The light assembly of claim 1, including snap assemblies for securing said light assembly in an opening.

14. An illuminated refrigerator drawer comprising:

a panel defining an opening therein;

a light assembly secured in said opening, said light source assembly including:

a light source assembly including a light emitting source;

a reflector;

a lens assembly;

a first keying means having a first keying means first component associated with said light source assembly and a first keying means second component associated with said reflector, said first keying means first and second components cooperatively associated for assembling said light source assembly and said reflector in a selected orientation with respect to each other;

a second keying means having a second keying means first component associated with said reflector and a second keying means second component associated with said lens assembly, said second keying means first and second components cooperatively associated for assembling said reflector and said lens assembly in a selected orientation with respect to each other;

a connector securing said light source assembly and said lens assembly to each other with said reflector held there between; and a snap assembly securing said light assembly in said opening.

15. The drawer of claim 14, said panel being a face panel of a housing including a top a bottom and sides.

16. The drawer of claim 14 including a front, and said panel being connected to said front.

17. An appliance light assembly comprising:

a light source assembly including a substrate and a light emitting diode, said substrate defining first and second holes therein;

a reflector including a funnel-like body, a skirt and first and second posts, said skirt engaging said substrate and said posts disposed in said holes; and a lens assembly including a lens and legs extending from said lens toward said substrate, said legs having hooked ends engaging said substrate with said lens engaging said reflector.

18. The appliance light assembly of claim 17, said reflector defining first and second notches and said lens assembly having ridges disposed in said notches.

19. The appliance light assembly of claim 17 including four said legs each having hooked ends engaging said substrate.

20. The appliance light assembly of claim 19 said legs provided in pairs on opposite side of said lens, said reflector and said substrate.

* * * * *